US005902060A

United States Patent [19]

Rodriguez

[11] Patent Number: 5,902,060

[45] Date of Patent: May 11, 1999

[54] DEPILATORY WAX APPLICATOR HEAD

[75] Inventor: M. Jesus Esmoris Rodriguez, Colmenar Viejo, Spain

[73] Assignee: Phytolab, S.L., Madrid, Spain

[21] Appl. No.: 08/588,408

[22] Filed: Jan. 18, 1996

[30] Foreign Application Priority Data

Jul. 6, 1995 [ES] Spain ..... 9501364

[51] Int. Cl.[6] ..... B05C 17/00; A45D 26/00

[52] U.S. Cl. ..... 401/1; 401/139; 401/266; 222/570; 222/566; 220/784

[58] Field of Search ..... 401/1, 2, 266, 401/264, 261, 263; 222/566, 567, 569, 570; 215/354, 321

[56] References Cited

U.S. PATENT DOCUMENTS

| | | | |
|---|---|---|---|
| 421,362 | 2/1890 | Underwood | 401/264 |
| 514,290 | 2/1894 | Symonds | 401/1 X |
| 2,094,700 | 10/1937 | Gunn | 401/264 |
| 2,913,748 | 11/1959 | Felter | 401/264 |
| 3,090,071 | 5/1963 | Le Brooy | 401/266 |
| 3,197,801 | 8/1965 | Diamond | 401/264 |
| 3,446,391 | 5/1969 | Yates, Jr. | 220/792 |
| 3,782,600 | 1/1974 | Columbus | 401/139 X |
| 4,117,946 | 10/1978 | Kessler | 220/784 X |
| 5,395,175 | 3/1995 | Bontoux et al. | 401/2 X |
| 5,727,893 | 3/1998 | Handler | 401/266 X |

FOREIGN PATENT DOCUMENTS

| | | | |
|---|---|---|---|
| 228588 | 6/1960 | Australia | 222/570 |
| 0273495 | 7/1988 | European Pat. Off. . | |
| 2467786 | 5/1981 | France | 401/1 |
| 2672273 | 8/1992 | France | 401/139 |
| 3310447 | 10/1983 | Germany | 401/266 |

*Primary Examiner*—Steven A. Bratlie
*Attorney, Agent, or Firm*—Ladas & Parry

[57] ABSTRACT

A depilatory wax applicator head (1) is provided. The applicator head is detachably engageable with a receptacle (7) for containing wax. The receptacle has an open end having a neck portion (6) with a non-cylindrical, elongated cross-section and extending along a longitudinal axis of the receptacle (7). A neck portion (6') may be provided by an intermediate part (12) detachably connected to the open end of the receptacle (7). The applicator head (1) is engageable with the neck portion (6, 6') along the longitudinal axis. The applicator head has an internal passageway and opposed ends of elongated cross-section. One of the ends includes a narrow outlet slot (10) and a spatula (11), and the other end has a mouth engageable with the neck portion (6, 6') of the receptacle (7). The mouth portion of the applicator head includes rigid peripherally spaced tongues (8) positioned on the inner wall of the passageway for clamping the applicator head (1) to the neck portion (6, 6') of the receptacle (7). The head also has strengthening ribs (9) extending to the outlet slot (10) to prevent deformation of the slot (10). The end of the spatula (11) can be furrowed and inclined. The walls (13) of the outlet slot (10) are inwardly convergent to facilitate the backflow of wax when the waxing operation is concluded.

8 Claims, 5 Drawing Sheets

DEPILATORY WAX APPLICATOR HEAD

OBJECT OF THE INVENTION

The invention relates to a depilatory wax applicator head designed to be detachably coupled onto the mouth of a wax-containing reservoir, said reservoir being in turn designed to be arranged inside a depilatory kit fitted with heating means to heat the wax that is to be applied.

The head is fitted with means for a perfect coupling onto the mouth of the wax-containing reservoir and the respective wax outlet is especially shaped and/or directed in order to achieve firstly a perfectly tight coupling between the head and the reservoir and secondly that the wax may be more effectively and easily applied by users.

BACKGROUND OF THE INVENTION

Many depilatory kits exist using the application of hot molten wax that is applied onto an area of users to be depilated. Reference can among these kits be made to that described in European patent 0273495 which includes an outer housing that is tapered at one end and fully open crosswise, thereby defining a means through which the wax lying inside exits. This housing is internally fitted with a wax-containing reservoir and the wax is heated with heating elements located inside the housing, the kit having a drive button which when pushed causes the wax-containing reservoir to be deformed and thus the wax to exit through the opening provided at the front of the housing.

The kit claimed in European patent 0273495 in short provides autonomous wax heating and dispensing means and the resulting kit is altogether quite expensive, without the wax-containing reservoir being replaceable.

There are moreover kits of the kind described where the head and the reservoir proper are coupled to each other in a scarcely effective manner, undersirably allowing wax to flow through the coupling when wax is applied.

DESCRIPTION OF THE INVENTION

The applicator head has been devised to fully solve the aforesaid problems and in particular to achieve a proper and effective coupling of the head onto the wax-containing reservoir. The wax outlet mouth is also shaped and directed to facilitate effective application of the wax in a simple manner.

The head of the invention is therefore tubular in shape and its contour complements the contour of the reservoir mouth onto which it is to be coupled, having a tapered extension where a narrow outlet slot is defined through which the wax is actually applied.

The tubular portion of this head includes an inner perimetric ridge that fits into a complementary groove provided to such end in the neck at the mouth of the reservoir, both parts or necks being thus held to each other. The inner portion of the head body is provided with rigid tongues that are slightly separated from the inner surface of the body and provide the means locking the edge at the neck of the reservoir mouth against the lateral wall of the head proper thereby providing a perfect fit and coupling between the parts to prevent wax from flowing through the coupling when the wax is applied through the head outlet.

The inner wall of the head is also provided with strengthening ribs for preventing the outlet slot proper from becoming deformed, thereby allowing the flow of wax from the outlet to be carried out effectively and continuously during use.

It is noteworthy that the head can be coupled onto the wax-containing reservoir or receptacle directly or through an intermediate part. The intermediate part is coupled on one side onto the mouth of the wax-containing reservoir or receptacle on the other side to the head.

The tapered portion of the head where the wax outlet slot is provided defines what could be termed a spatula. The spatula may be a fixed part which is integral with the head body or a detachable replaceable part.

The outlet mouth is provided on one side with furrows forming a sort of toothed edge, in order to provide thicker and hence stronger wax areas to facilitate pulling off the applied strips of wax. The walls of the outlet mouth of this head are on the other side inwardly convergent so that when the wax application operation is over, the surplus wax is urged to slide inwards instead of outwards.

The axis of the spatula and hence of the head outlet slot lies perpendicular to the centerline of the wax-containing reservoir and the head proper. Alternatively, an inclined edge can be defined to modify the way in which wax is applied, lying at either a right angle or at less than a right angle to the center line.

It should finally be noted that the wax-containing reservoir or receptacle can have any shape whatsoever, and the tube can be oval or rectangular in section or can indeed be shaped as a toothpaste tube.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following:

FIG. 3 is a longitudinal section view of the coupling between the head of the invention and a wax-containing receptacle, coupling being effected by locating an intermediate part in between.

PREFERRED EMBODIMENT OF THE INVENTION

Figure 1:
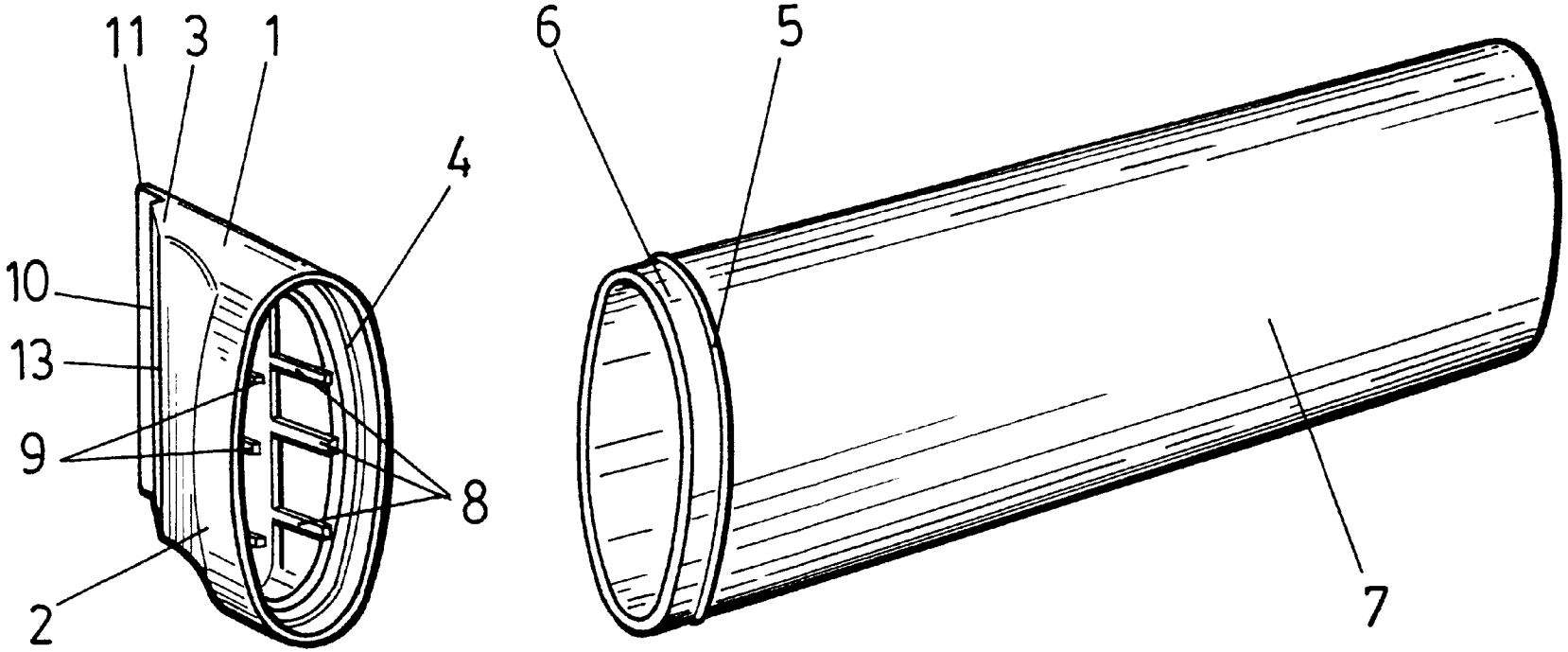
FIG. 1 is a general perspective view of a wax applicator head made in accordance with the object of the invention, and next to it a perspective view of the wax-containing receptacle onto which said head is couplable.

With reference to the figures aforesaid, and in particular FIG. 1, the head (1) of the invention is comprised by a hollow body having a tubular portion (2) and a tapered portion (3), the tubular portion being internally provided with a perimetric ridge or groove (4) for engaging a perimetric ridge or groove (5) lying in the neck (6) at the mouth of the wax-containing receptacle (7) to be coupled, said neck (6) of said receptacle (7) for coupling onto the head (1) having to be of an analogous shape. The neck (6) of the receptacle (7) therefore has a non-cylindrical, elongated cross-section for engaging the mouth end of the applicator head (1) which also has an elongated cross-section. Tongues (8) are provided inside the head body (1) which, as shown in the section views of FIGS. 3 and 4, press the receptacle neck (6) against the lateral wall of the head proper.

Figure 4:
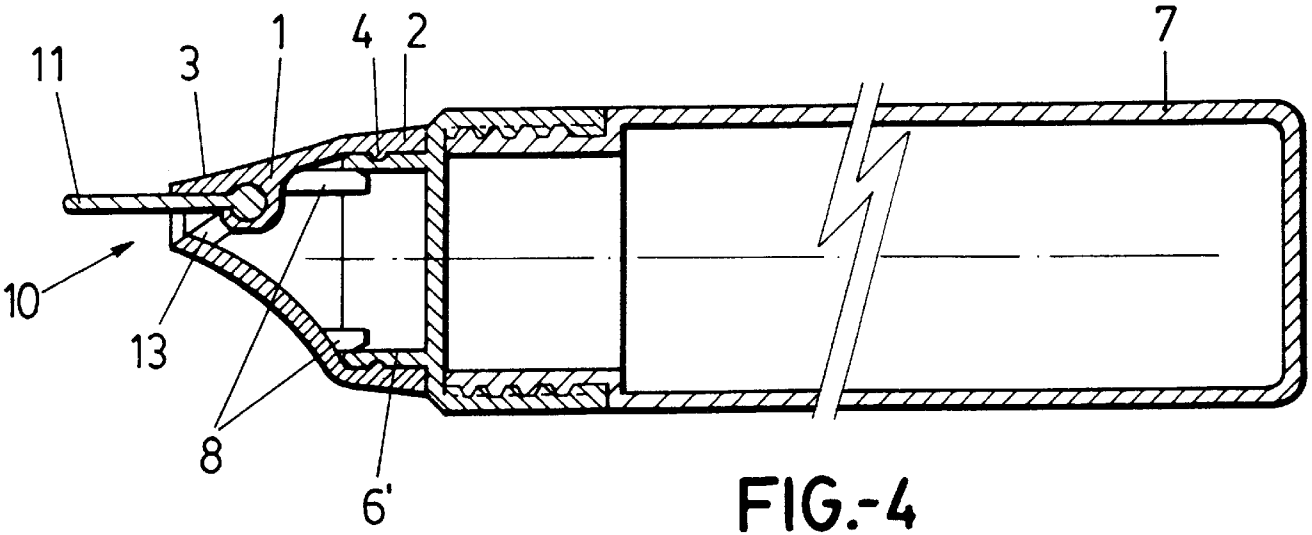
FIG. 4. is a view similar to the above, in this case with the head spatula comprising a separate part, detachable by sliding it sideways.
Figure 3:
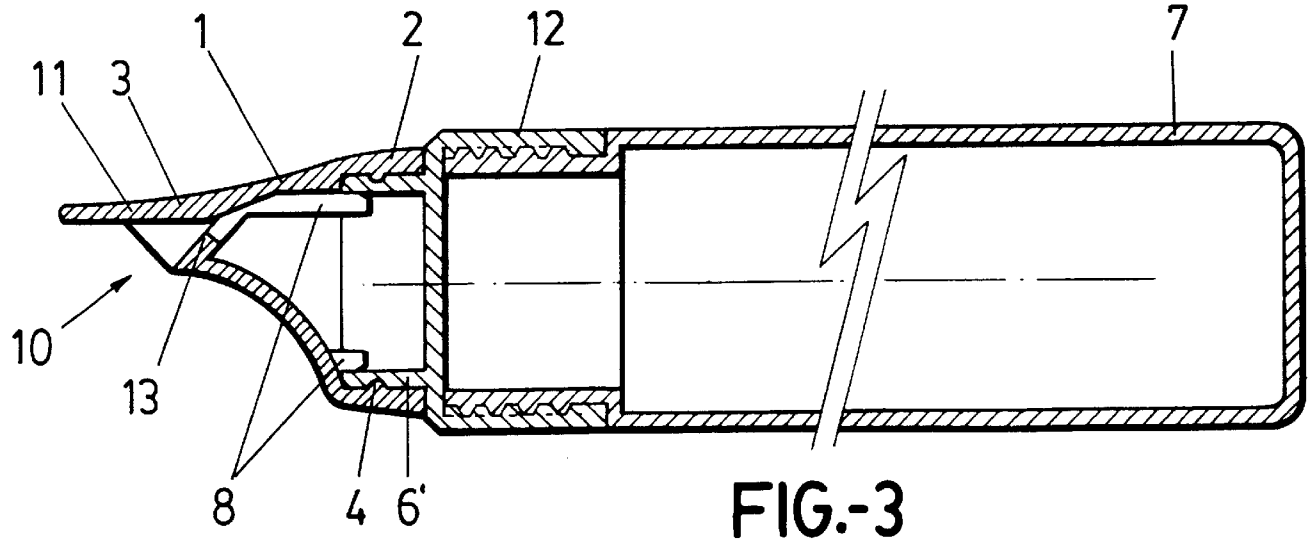

Furthermore, there are strengthening ribs (9) inside the head body (1) which reach from the mouth as such of the head (1) up to the wax outlet slot (10), which slot is provided in the tapered portion (3), i.e. opposite the mouth of the head body (1), and from said outlet slot an extension is defined in the form of a spatula (11) which may be a fixed part, as shown in FIG. 3, i.e. forming a body integral with the head (1), or a separate part as shown in FIG. 4, being attachable and detachable by sliding sideways.

The head (1) aforesaid can be coupled directly onto the receptacle (7) or else through an intermediate part (12), as shown in FIGS. 2, 3, 4 and 5, in which case said intermediate part (12) will have suitable means to be coupled onto the receptacle (7) and in turn a neck (6') being analogous to neck (6) shown in the receptacle (7) of FIG. 1, i.e. said neck will be likewise provided with a groove or ridge (5') to complement the ridge or groove (4) of the head (1) proper.

Figure 2:
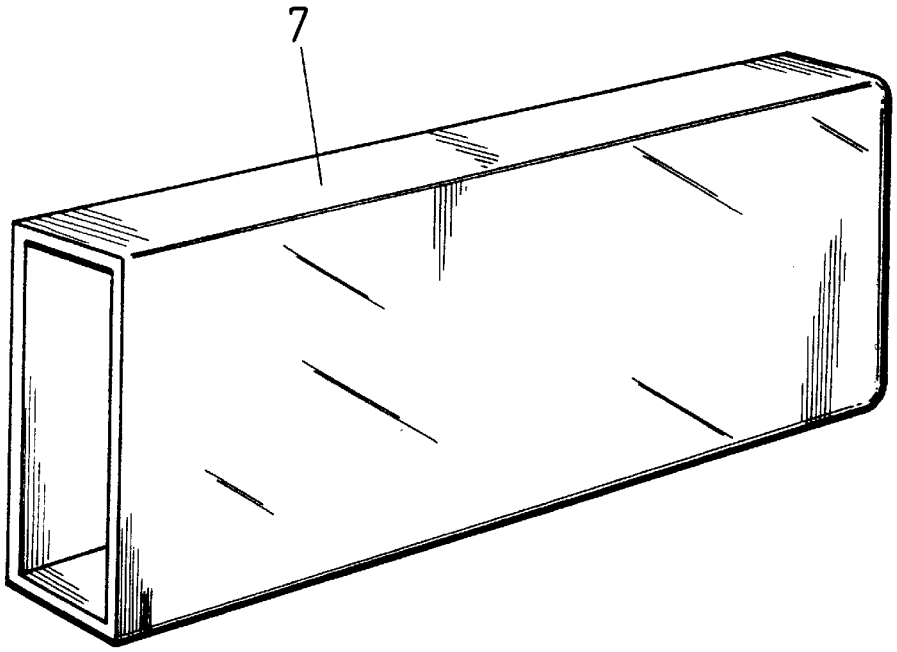
FIG. 2 is another perspective view of a head and a receptacle, being in this case prismatic-rectangular in shape, an intermediate coupling part being provided between the head and the wax-containing reservoir or receptacle proper.
Figure 2:
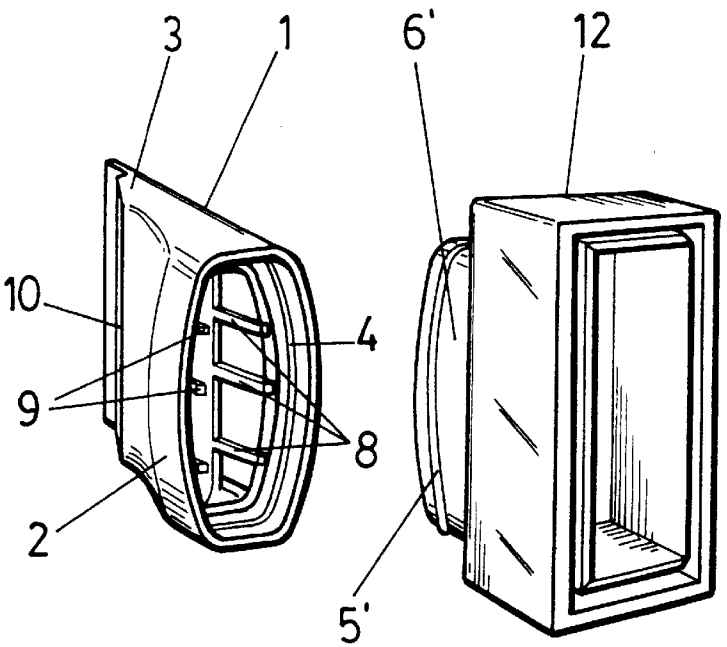
Figure 5:
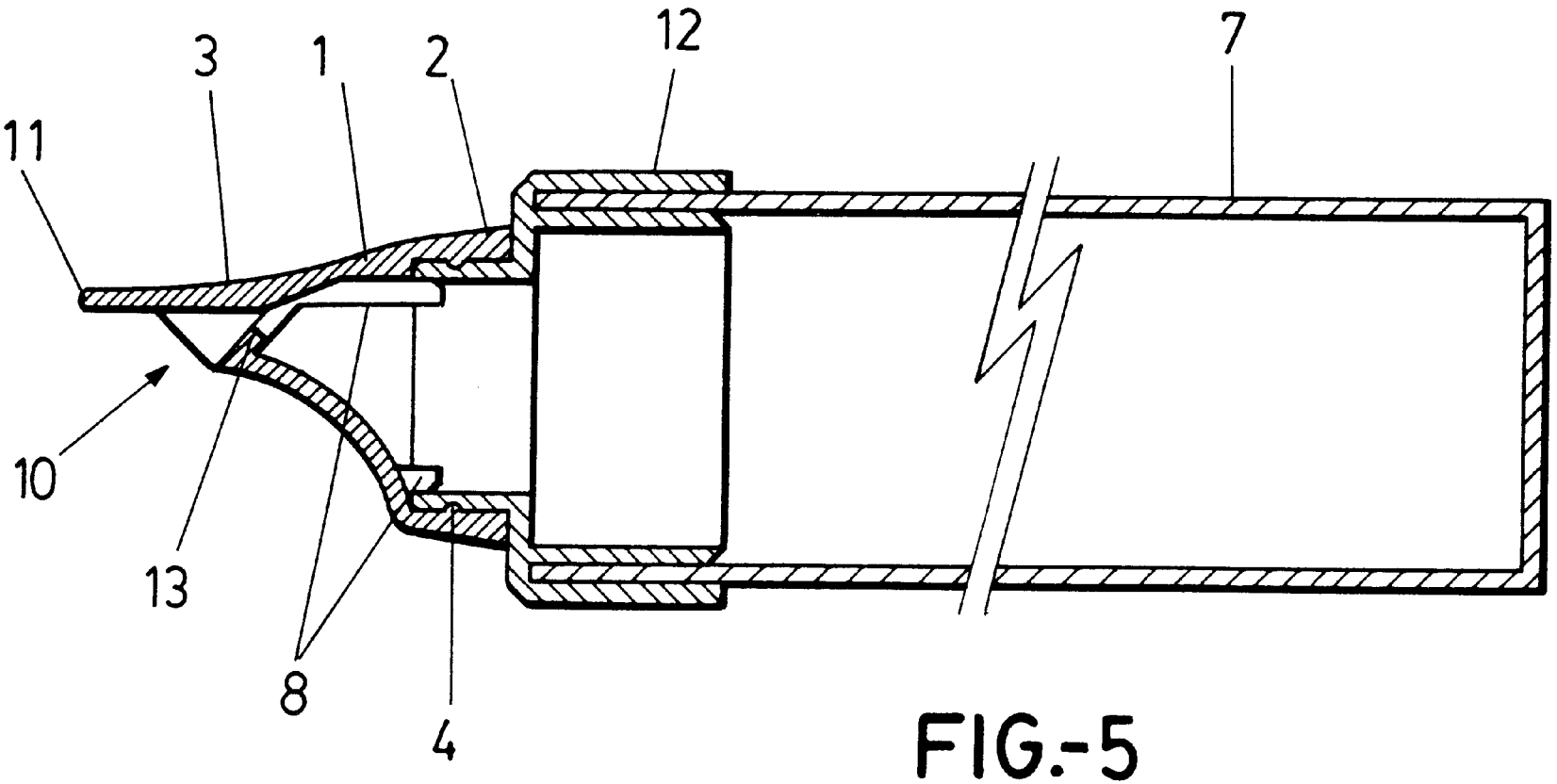
FIG. 5 is another longitudinal section view as in FIG. 3, though the manner in which the intermediate part and the wax-containing reservoir proper are coupled is different.
Figure 6:
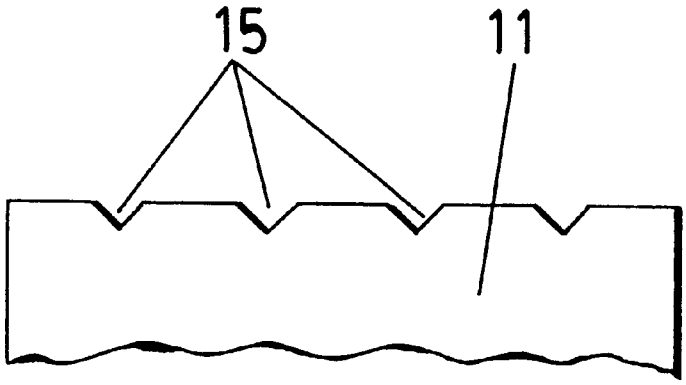
FIG. 6 is a schematic view of the edge, now furrowed, of the spatula with which the head of the invention is provided.
Figure 7:
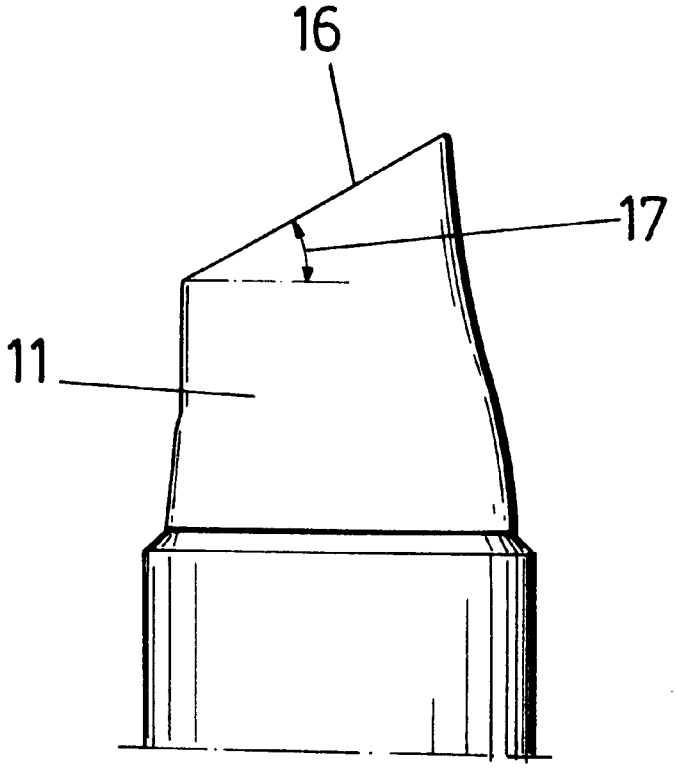
FIG. 7 is a schematic side elevation close view of the head proper where the outlet slot defines an inclined edge.

As shown in FIGS. 3 and 4, the coupling between said wax-containing reservoir or receptacle (7) and the intermediate part (12) takes place by screwing, whereas when the reservoir or receptacle (7) is prismatic in shape or shaped otherwise than cylindrically, coupling takes place by plugging the mouth of the receptacle (7) onto a groove defined between a double wall provided to such end in the intermediate part (12), as shown in FIGS. 2 and 5. on pressing the neck (6) or (6') coupling the head to the receptacle (7) or intermediate part (12), the tongues (8) of the head (1) will in any event prevent the outlet of wax at the coupling when the wax is applied and duly leaves through the front slot (10).

The strengthening ribs (9) respectively prevent the outlet slot (10) from being deformed so as to permit the interrupted flow of wax.

The outlet slot (10) of the head (1) has also been provided to have inwardly convergent walls (13) so that when the wax application operation is over, surplus wax will slide inwards instead of sliding outwards and the application operation will thus be absolutely clean until it is definitively over.

The edge of the spatula (11) may also be furrowed (15) thereby to provided areas of greater wax thickness, so that it will therefore be easier to later pull off the strips of wax.

The axis of the spatula (11), or in other words the outlet slot (10), lies perpendicular to the centerline of the head (1) proper, and hence the wax-containing reservoir (7), as shown in FIGS. 1 to 5. Alternatively, said spatula (11) could have its edge (16) lying at an angle (17) or could in other words define an inclined edge to modify the manner in which wax was applied, which would be convenient and indeed easier and more effective in certain instances and conditions. The spatula may also lie at a right angle which would also modify the manner in which the wax was applied.

I claim:

1. A depilatory wax applicator head (1) for detachable egagement with a receptacle (7) for containing wax, said receptacle (7) having an open end having a neck portion with a non-cylindrical, elongated cross-section and extending a long a longitudinal axis of said receptacle (7), said applicator head (1) being engageable with said neck portion (6) of said receptacle (7) along said longitudinal axis, said applicator head (1) having an internal passageway extending along said longitudinal axis and opposed ends of elongated cross-section, wherein one of said ends has a narrow outlet slot (10) and there is included a spatula (11) extending from and adjacent said slot (10), and the other of said ends of said applicator head (1) has a mouth engageable with said neck portion (6) of said receptacle (7), and including tongues (8) peripherally spaced adjacent the mouth and with respect to the opposing inner wall of the passageway of the applicator head (1) for engaging the interior surface of the neck portion (6) of receptacle (7), said inner wall of the applicator head (1) engaging the neck portion of the receptacle (7), said tongues (8) being sufficiently rigid and positioned relative to the inner wall of the applicator head (1) to clamp the neck portion (6) of receptacle (7) between said tongues (8) and said inner wall of said applicator head (1) so as to maintain a tight seal between the applicator head (1) and the neck portion (6) of receptacle (7) while allowing an outflow of the wax from the outlet slot (10), said applicator head (1) further including spaced strengthening ribs (9) positioned along and closely adjacent the inner wall of the applicator head (1), said ribs (9) extending to at least the outlet slot (10) for preventing the slot (10) from becoming deformed.

2. A depilatory wax applicator head, as in claim 1, characterised in that the head spatula (11) can be replaceable or fixed with respect to the head body (1) and can in any event have a furrowed edge (15) in order for thicker wax areas to be formed as the wax exits.

3. A depilatory wax applicator head, as in claim 1, characterised in that the spatula (11) has an inclined edge (16) lying at an angle (17) that is less than or equal to a right angle, modifying the manner in which the wax is applied.

4. A depilatory wax applicator head as in claim 1, wherein said head (1) is coupled directly onto the wax-containing reservoir (7).

5. A depilatory wax applicator head (1) as in claim 1, wherein said means for engaging said applicator head and said receptacle (7) further includes a perimetric ridge (4) formed on an inner wall of said applicator head for engaging a complementary perimetric groove (5) provided in an outer wall of said open end of said receptacle.

6. A depilatory wax applicator head (1) as in claim 1, wherein said outlet slot (10) is provided with inwardly convergent walls (13).

7. A depilatory wax applicator head (1) as in claim 1, wherein the neck portion (6') of the receptacle is contained in an intermediate part (12) with an internal passageway and detachably connected to the open end of said receptacle (7) said applicator head (1) being engageable with said neck portion (6') of said intermediate part (12) along said longitudinal axis.

8. A depilatory wax applicator head as in claim 7 wherein said applicator head (1) further includes a perimetric ridge (4) formed on an inner wall thereof for engaging a complementary perimetric groove (5) provided on an outer wall of said neck portion (6') of said intermediate part (12).

* * * * *